US005927728A

United States Patent [19]

Gignoux et al.

[11] Patent Number: 5,927,728

[45] Date of Patent: Jul. 27, 1999

[54] IN-LINE ROLLER SKATE EQUIPPED WITH A BRAKE

[75] Inventors: Pierre Gignoux, Le Sappey-En-Chartreuse, France; Gaston Haldemann, Burgenstock, Switzerland

[73] Assignee: Skis Rossignol S.A., Le Menon, France

[21] Appl. No.: 08/812,119

[22] Filed: Mar. 5, 1997

[30] Foreign Application Priority Data

Mar. 11, 1996 [FR] France ..... 96 03245

[51] Int. Cl.[6] ..... A63C 17/04

[52] U.S. Cl. ..... 280/11.2

[58] Field of Search ..... 280/11.2, 11.21, 280/11.22, 11.19; 188/17, 26, 195

[56] References Cited

U.S. PATENT DOCUMENTS 5,192,099 3/1993 Riutta .
5,342,071 8/1994 Soo ..... 280/11.2
5,639,104 6/1997 Haldemann ..... 280/11.2
5,755,449 5/1998 Pozzobon ..... 280/11.2

FOREIGN PATENT DOCUMENTS 0 568 878 11/1993 European Pat. Off. .
0 607 817 7/1994 European Pat. Off. .
0 677 310 10/1995 European Pat. Off. .

*Primary Examiner*—Matthew C. Graham
*Assistant Examiner*—G. T. Bartz
*Attorney, Agent, or Firm*—Kane, Dalsimer, Sullivan, Kurucz, Levy, Eisele and Richard, LLP

[57] ABSTRACT

An in-line roller skate including a main chassis (1) supporting at least two rollers (5, 6), and an auxiliary chassis (8) which is articulated onto the main chassis and bears at least the rear roller (10). The skate includes a pair of discs (13) which are mounted so as to rotate and the frustoconical faces of which are applied onto the two rear rollers (6, 10) when the skate tilts rearward, braking being ensured by friction of the discs on the rotationally fixed parts of the skate.

9 Claims, 5 Drawing Sheets

FIG.1
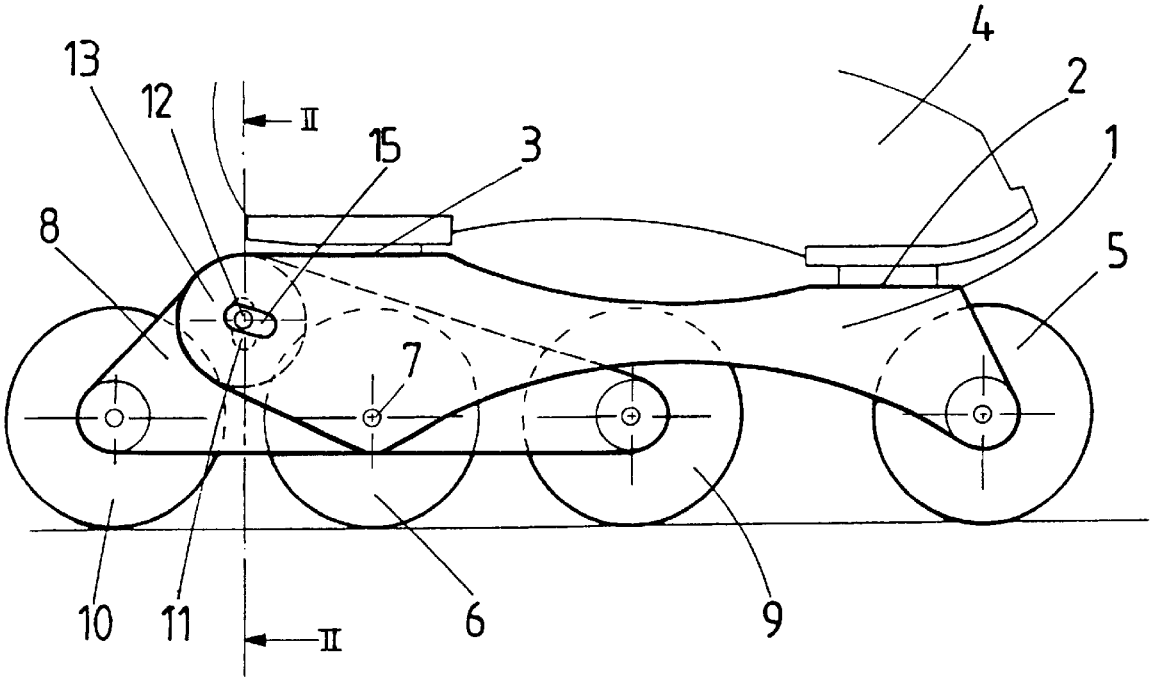
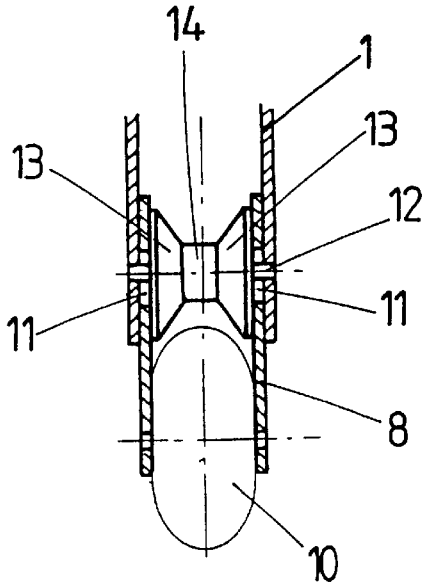
FIG. 2

FIG. 3
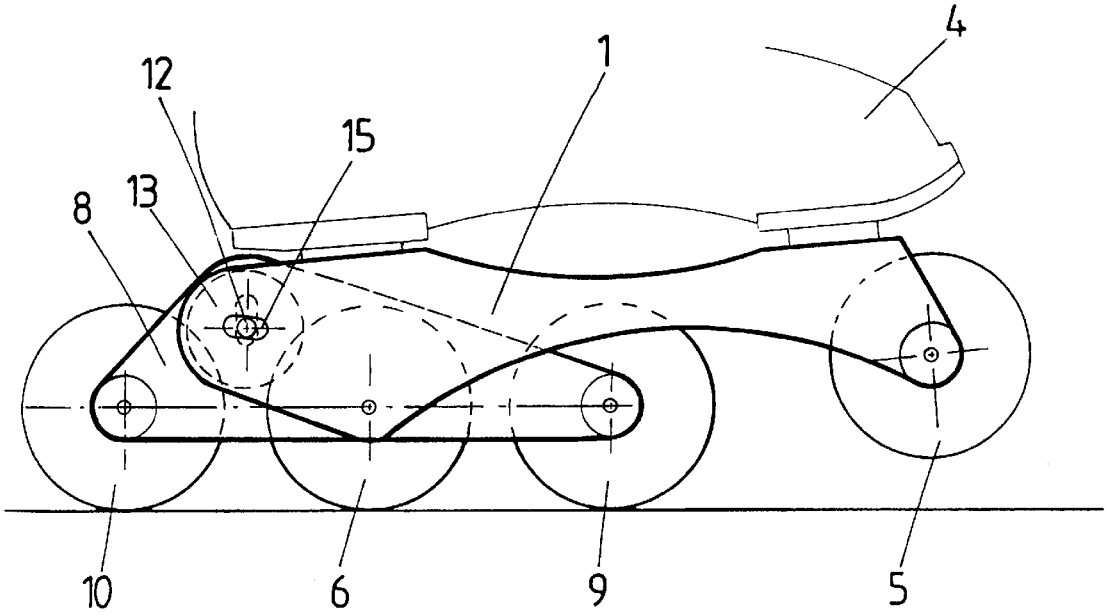
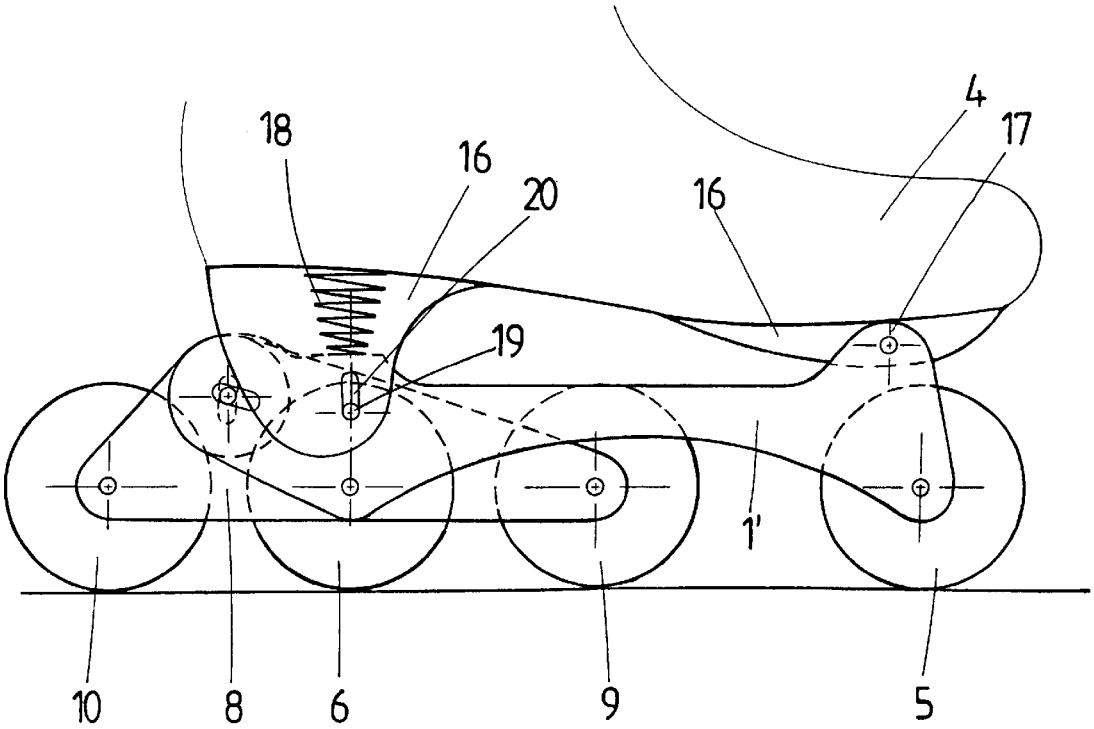
FIG. 4

IN-LINE ROLLER SKATE EQUIPPED WITH A BRAKE

FIELD OF THE INVENTION

The subject of the present invention is an in-line roller skate comprising at least three rollers, of which at least the rear roller is mounted on an auxiliary chassis which is articulated, about an axle parallel to the axle of the rollers, onto a main chassis supporting a boot, and a brake kinematically linked to the auxiliary chassis so as to brake at least the penultimate roller when the skate tilts rearward on the penultimate roller, and elastic means which counteract this tilting.

PRIOR ART

A skate of this type is disclosed by patent application EP 0 677 310. In this skate, it is a part of the auxiliary chassis which constitutes a brake shoe which comes into contact with the tread of the penultimate roller when the main chassis tilts on the penultimate roller. In addition, the rear of the main chassis comes to bear on the last roller to brake it. The skater's weight is exerted between the two rear rollers. The means which counteract the tilting consist of a spring which works in compression between the two chassis and is prestressed. It is therefore necessary to adjust the prestress as a function of the skater's weight. The spring may also be fully prestressed so as to prevent the main chassis from tilting relative to the auxiliary chassis, the skate then behaving like a single-chassis skate with four rollers and without a brake.

U.S. Pat. No. 5,088,748 further discloses a skate which, at the rear, is provided with an auxiliary roller articulated onto the end of an arm which is itself articulated onto the rear end of the chassis, this roller coming into contact with the ground only when the skate tilts on the rear roller, the pressure of the auxiliary roller applying a brake onto the rear roller or the segment of a disc which is secured to the rear roller and is concentric therewith.

U.S. Pat. No. 5,375,859 describes a similar skate in which the brake consists of two disc brakes mounted on each side of the rear roller, braking taking place by the application of the rotationally fixed discs against ring-shaped discs secured to the roller. The heat produced by the braking must then be substantially removed via the roller itself, and the heating of the roller is such that it may become damaged.

In this type of skate, with a brake controlled by the auxiliary roller which comes into contact with the ground only after the skate has tilted through a certain angle, it is also difficult to have progressive initial braking, in view of the complete absence of balance for a skate bearing on a single roller during the first tilting phase, this being even more so since, before tilting, the body weight acts in front of the rear roller and it is therefore necessary firstly to shift the body weight into vertical alignment with the axle of the rear roller.

SUMMARY OF THE INVENTION

The object of the present invention is to obtain more uniform braking which is easier to control and does not significantly heat the rollers.

The in-line roller skate according to the invention is one wherein the brake consists of a pair of opposite coaxial discs, mounted so as to rotate and kept separated from each other by an elastic means, the opposing faces of these discs being at least approximately frustoconical and intended to come into contact with the two sides of the two rear rollers in order to be rotated by the rear rollers, braking being ensured by the friction of the discs on rotationally fixed parts of the skate, and wherein the axle of these discs is located between the two rear rollers, above the axles of these rollers and equidistant from these axles, and wherein the mechanical linkage between the discs and the auxiliary chassis is such that, when the skate tilts rearward, this axle descends toward the straight line joining the axles of the two rear rollers, so that the discs are applied onto the two rear rollers.

During braking, the discs are drawn downwards and applied onto the two rear rollers, which ensures uniform pressure of the penultimate roller on the discs.

Since the discs are rotated by the two rear rollers, braking takes place by friction between the discs and the main chassis. The discs are preferably themselves made of a material used for brake linings and rub directly on one of the main chassis or on a metal disc fixed to the chassis, which prevents the rollers from being heated and promotes removal of the heat via the chassis.

BRIEF DESCRIPTION OF THE DRAWINGS

The appended drawing represents, by way of example, four embodiments of the invention.

FIG. 1 represents a skate according to a first embodiment, in the unbraked running position.

FIG. 2 is a partial view in section on II—II in FIG. 2, showing the brake discs.

FIG. 3 represents the same skate in the braking position.

FIG. 4 represents a variant of the first embodiment, with elastic suspension.

DESCRIPTION OF THE PREFERRED EMBODIMENTS

Figure 5:
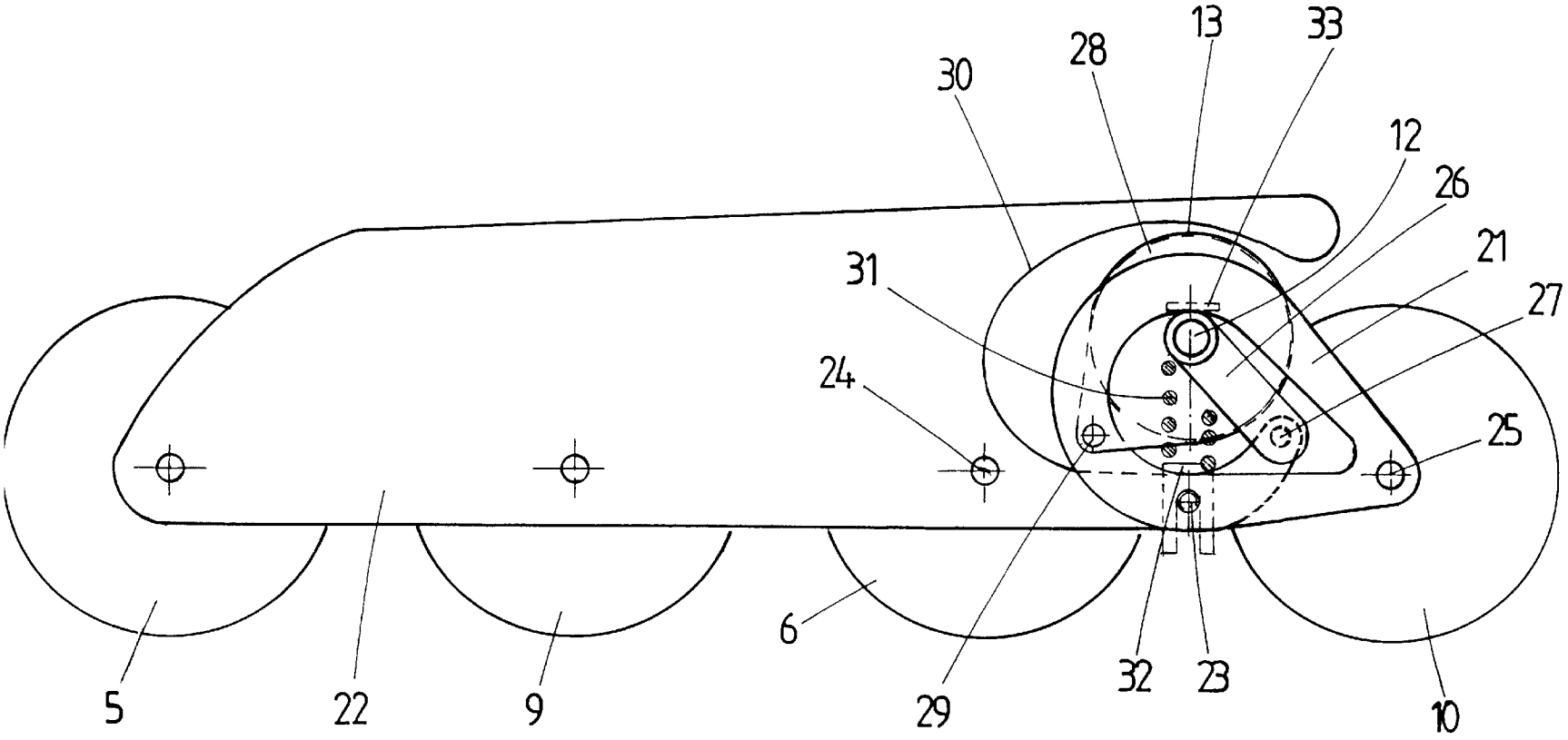
FIG. 5 represents a skate chassis according to a second embodiment.

The skate represented in FIG. 1 comprises a main chassis 1 consisting of a U-shaped profiled piece which is cut so as to have a front platform 2 and a rear platform 3 which support a boot 4. The chassis 1 is provided with two rollers 5 and 6. The roller 5 is in front of the front platform 2, while the roller 6 is located under the rear platform 3, so that its axle 7 is located under the heel of the boot 4. An auxiliary chassis 8 is articulated on the chassis 1 about the axle 7 of the roller 6. This auxiliary chassis 8 may also consist of a U-shaped profiled piece which fits into the main chassis 1, or of two cross-braced plates. This auxiliary chassis 8 supports two rollers 9 and 10, the roller 9 being located between the rollers 5 and 6, and the roller 10 being located to the rear of the main chassis 1. The roller 9 is optional.

The auxiliary chassis 8 has two identical slots 11, facing each other, located between the two rear rollers 6 and 10, equidistant from the axles of the rollers 6 and 10 and extending perpendicular to the straight line joining these axles. An axle 12 whose diameter corresponds to the width of the slots 11 passes through these slots, this axle 12 supporting a pair of discs 13 whose opposing faces are frustoconical (FIG. 2), these discs being mounted freely on the axle 12, at least axially, and being kept separated from each other, bearing against the walls of the auxiliary chassis 8, by an elastic element 14. The axle 12 can therefore move vertically in the slots 11. The ends of the axles 12 are also engaged in a pair of slots 15 formed in the main chassis 1. The slots 15 are slightly inclined in the direction of the penultimate roller 6. The discs 13 are preferably made of a material of the Ferodo type (registered trademark) and their plane outer faces are directly applied against the auxiliary chassis 8.

The skate is also provided with an elastic means (not represented) which counteracts the tilting of the main chassis 1 on the auxiliary chassis 8. This elastic means may, for example, be a torsion spring mounted about the axle 7, or a spring working in tension between the two chassis.

When the main chassis 1 tilts about the axle 7 of the penultimate roller, as represented in FIG. 3, the axle 12 of the discs is driven downward by the slots 15 and guided in this movement by the slots 11.

The brake discs 13 are applied simultaneously onto the two rear rollers 6 and 10, and they are rotated by these rollers. The conical shape of the discs causes the discs to be moved apart by the rollers, and consequently causes braking by friction of the discs against the auxiliary chassis 8.

The slots 15 could be horizontal, but inclining them has the effect of increasing the descent of the axle 12 by the cam effect which is added to the descent of the slots 15.

A variant of this first embodiment is represented in FIG. 4. This variant differs from the first embodiment only by the shape of the main chassis 1' and the mounting of the boot 4 on this main chassis. The sole of the boot is secured to a frame 16 which is articulated onto the front of the chassis 1' about a transverse axle 17 and can move vertically at the rear where a spring 18, or other elastic element, is interposed between the chassis 16 and the rear platform of the chassis 1'. In this region, the frame 16 therefore has two parallel flanks extending on each side of the chassis 1'. The travel of the boot is limited, on each side of the chassis 1', by two studs 19, each engaged in vertical slots 20 of the frame 16. The slots 20 are vertically in line with the axle of the roller 6. The auxiliary chassis 8 and the brake are identical to those in the first embodiment.

In the embodiments described above, the pressure and the friction of the axle 12 on the side of the slot 15 are significant and may entail a wear problem in the long term. The embodiment represented in FIG. 5 has the object of overcoming this wear problem by replacing the lowering of the axle 12 of the brake discs by cam effect by an articulated system of the pantograph type. In this second embodiment, an auxiliary chassis 21, consisting of two parallel plates cut in a ring shape, is articulated onto a main chassis 22 about an axle 23 located between the penultimate roller 6 and the last roller 10, slightly below the straight line joining the axle 24 of the roller 6 and the axle 25 of the roller 10, and equidistant from these axles. The plates of the auxiliary chassis 21 are articulated onto the exterior of the main chassis 22. The axle 12 of the brake discs 13 is located above the axle 23, vertically in line with this axle (when the skate is resting on a horizontal surface), and it is connected, on the one hand, to the main frame 22 by a first pair of levers 26, which are articulated onto the rear of the main frame 22 about an axle 27, and, on the other hand, to the auxiliary chassis 21 by a pair of brake plates 28, which are articulated onto the auxiliary chassis 21 about an axle 29 and correspond mechanically to a second pair of levers. The lengths of all these levers, measured between their articulation axles, are identical so that the axle 12 of the discs is at the same distance from the axles 27 and 29. The distance between the axles 23 and 29 is also equal to the distance between the axles 23 and 27, so that the articulations constitute a pantograph and the axle 12 is always equidistant from the axles 24 and 25 of the rollers. The brake plates or levers 28, which are made of aluminum, are located inside the auxiliary chassis 21, in oval cutouts 30 formed in the main chassis 22. The height of these cutouts 30 is sufficient to allow vertical movement of the brake plates 28. The axle 12 of the brake discs is also supported by a spring 31 which bears on a stop 32 mounted on the axle 23. The upward movement of the axle 12 is limited by a stop 33 fixed to the main chassis 22. The tilting of the main chassis 22 on the penultimate roller 6 has the effect of deforming the pantograph formed by the articulated system, so that the axle 12 descends in the direction of the axle 23. The brake discs 13 are then driven by the rollers 6 and 10 and are applied against the brake plates 28.

The plates 28 descend with the discs 13 and do not oppose this descent, in contrast to the first embodiment in which the discs 13 must slide on the auxiliary chassis.

Figure 6:
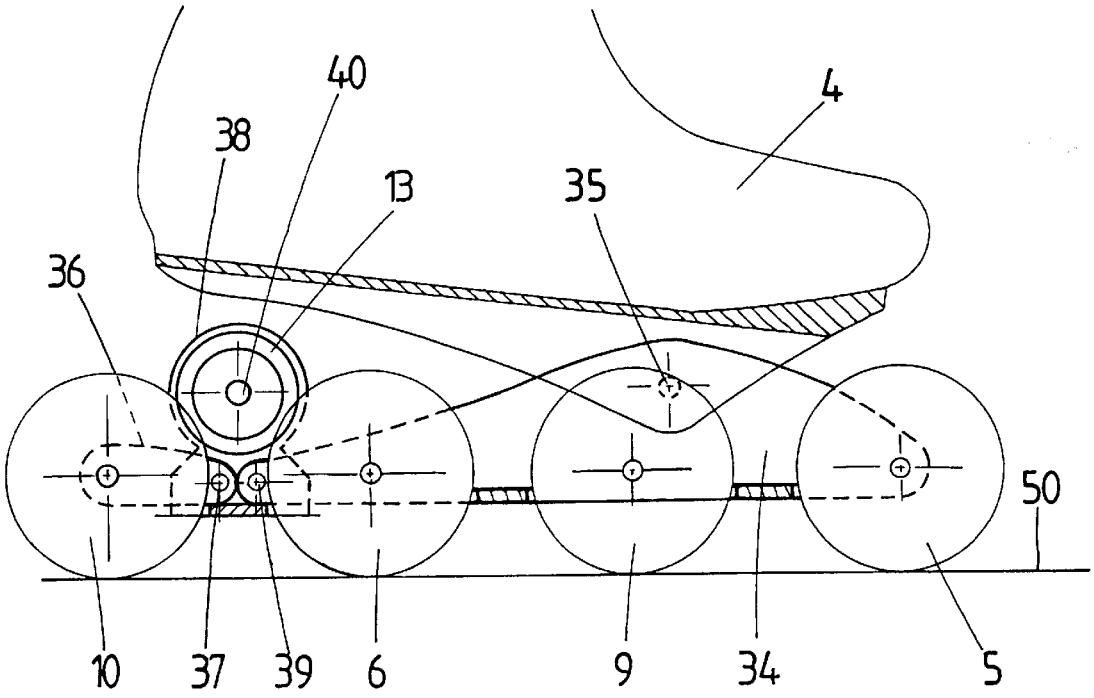
FIG. 6 represents a third skate embodiment in the unbraked running position.
Figure 7:
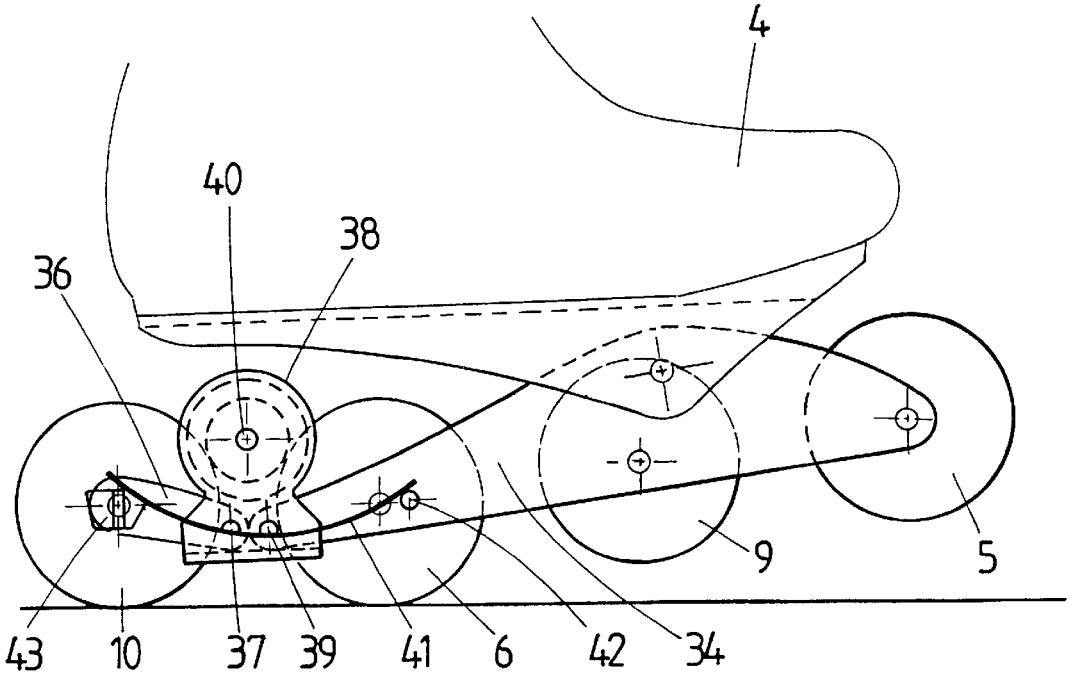
FIG. 7 represents the same skate in the braking position.

According to the third embodiment, represented in FIGS. 6 and 7, the boot 4 is articulated, about an axle 35, onto a main chassis 34, and an elastic means (not represented) presents a resistance to the rotation of the boot 4 about this axle 35. The boot 4 could, however, be mounted rigidly on the chassis 34. This chassis 34 consists of a U-shaped profiled piece whose flanks are directed upward. The bottom of this profile is cut to allow the rollers 5, 9 and 6 to pass. The rear roller 10 is mounted at the rear end of an auxiliary chassis 36 which consists of two parallel plates articulated about an axle 37 onto a fork-shaped piece 38 whose bottom is located below the axle 37. This fork 38 is further articulated onto the main chassis 34 about an axle 39 located at the same level as the axle 37 and, like it, parallel to the axles of the rollers. The axles 37 and 39 are located just above the bottom of the fork 38, this bottom being cut to allow the rollers 6 and 10 to pass. The brake discs 13 are rotationally mounted about an axle 40 inside the fork 38. As can be seen in FIG. 7, the fork encloses the ends of the two chassis 34 and 36. A spring 41 is mounted on each side of the fork 38, this spring consisting of a bar working in flexion and bearing, on one side, on a stud 42 of the main chassis 34 and, on the other side, on a block 43 which has a plurality of facets, making it possible to adjust the pretension of the spring 41. In its central region, the spring bears on the ends of the axles 37 and 39 with a prestress which can be adjusted by means of the block 43. This adjustment makes it possible to avoid the constraint of having the body weight on or in front of the axle of the penultimate roller thereby balancing it with the reaction of a spring calibrated as a function of the user's weight.

At rest, the springs 41 therefore push the fork 38 upward, this movement being limited by the ends of the two chassis 34 and 36 coming to abut against the bottom of the fork 38.

When the main chassis 34 tilts about the roller 6, the fork 38 is drawn downward by the axle 39, while flexing the springs 41, and the brake discs 13 are applied onto the wheels 6 and 10 and against the fork 38, which constitutes the fixed part of the disc brake. By bearing on the penultimate roller 6, the discs 13 drive the axle 37 in descent, and the pressure of the discs 13 on the rollers 6 and 10 is balanced by itself.

In an alternative embodiment in which the boot is fixed rigidly to the main chassis 34, the springs 41 could be replaced by a tension spring between the boot and the axle 40 of the brake discs.

Figure 8:
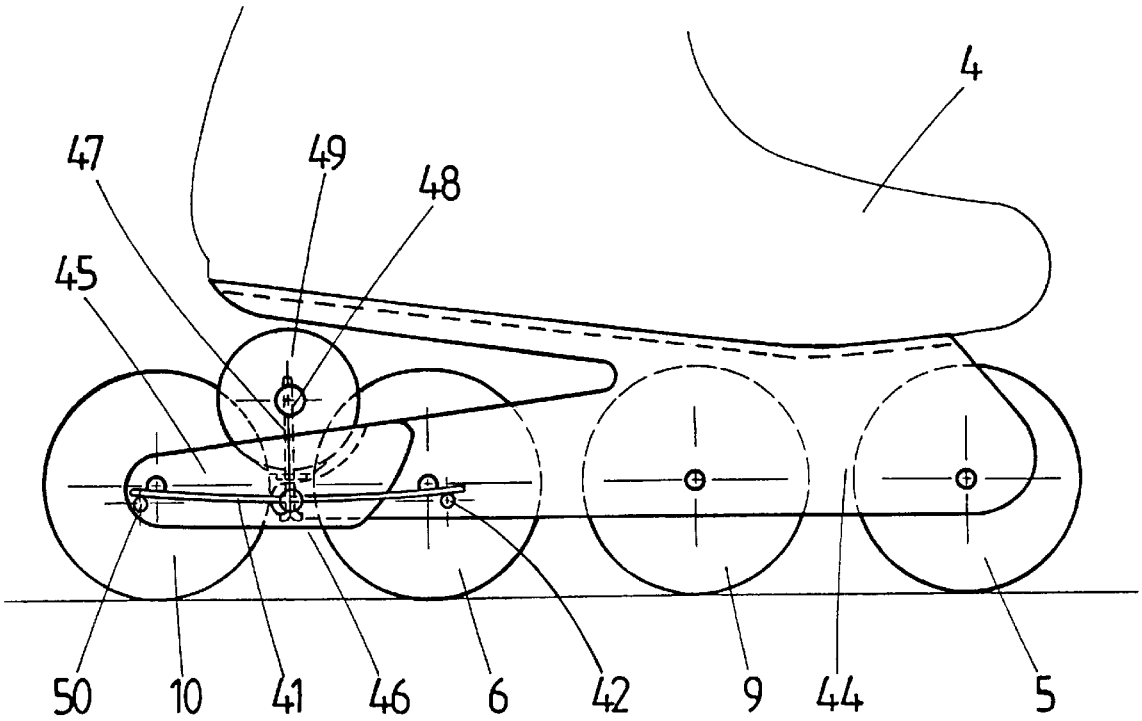
FIG. 8 represents a fourth embodiment in the unbraked running position.
Figure 9:
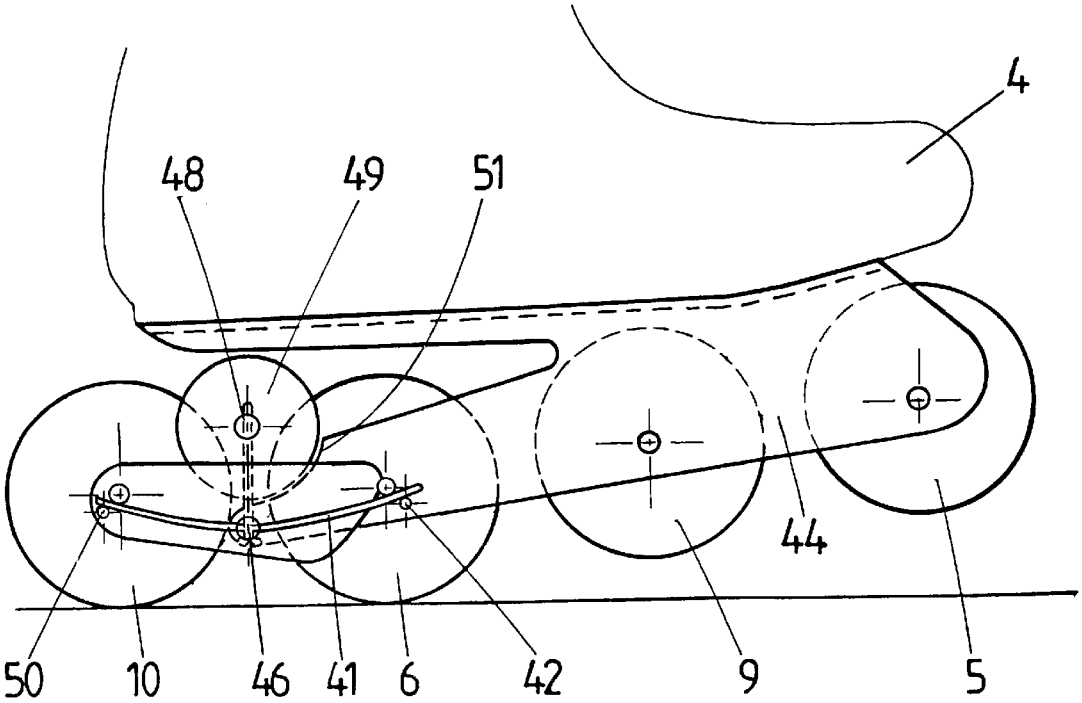
FIG. 9 represents this same skate in the braking position.
Figure 5:
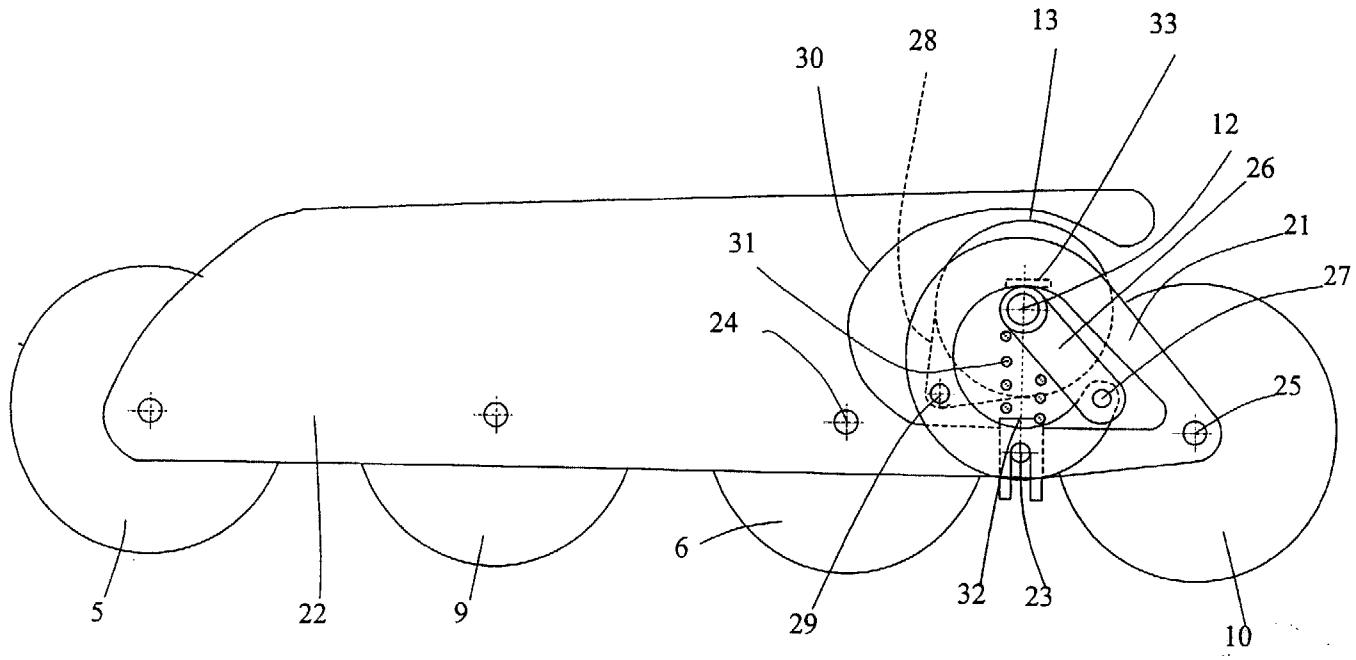

The fourth embodiment, represented in FIGS. 8 and 9, is derived from the previous embodiment. The boot 4 is mounted on a main chassis 44 consisting of a U-shaped profile in which the rollers 5, 9, 6 are articulated. The rear roller 10 is mounted at the rear end of an auxiliary chassis 45 formed by two parallel plates, arranged on each side of the main chassis 44 and articulated onto this main chassis about an axle 46. A vertical bar 47 is screwed from the bottom into this axle 46, extends in the central plane of the chassis and has its upper end screwed into a transverse axle 48 to each of whose ends a circular plate 49 is fixed perpendicularly, the diameter of this plate corresponding to the diameter of the brake discs 13 which are mounted free to rotate on the axle 48 between the plates 49. The plates 49 are located between the plates of the auxiliary chassis 45, in the same plane as the flanks of the main chassis 44, which have a recess 51 for this purpose. The springs 41 and the studs 42 are again encountered, the posterior end of the springs 41 bearing on studs 50 of the auxiliary chassis 45. The springs 41 also pass through the axle 46.

When the main chassis 44 tilts about the roller 6, as represented in FIG. 9, the axle 46 is driven in the direction of the ground and the brake discs 13 come to bear against the rollers 6 and 10 and are applied against the fixed discs 49.

Via its part which is screwed into the axle 48, the bar 47 also makes it possible to adjust the position of the brake discs as a function of the diameter of the rollers which are employed.

We claim:

1. An in-line roller skate having a brake mechanism, the skate comprising at least three rollers (5, 6, 9, 10), of which at least the rear roller (10) is mounted on an auxiliary chassis (8; 21; 36; 45) wherein, the auxiliary chassis may be articulated about a first axle (7; 23; 39; 46) parallel to the axis of the rollers against a main chassis (1; 22; 34; 44) supporting a boot (4); wherein a brake (13) is kinematically linked to the auxiliary chassis so as to impede at least the penultimate roller when the skate tilts rearward on the penultimate roller (6), first elastic means (31; 41) counteracting this tilting; wherein the brake consists of a pair of opposite coaxial discs (13), mounted so as to rotate about a second axle (12; 40; 48) and keep separated from each other by a second elastic means (14), the opposing faces of these discs being at least approximately frustoconical and intended to come into contact with the two sides of the two rear rollers (6, 10) in order to be rotated by these rollers, braking being ensured by the friction of the discs on rotationally fixed parts of the skate; wherein the second axle (12; 40; 48) which is located between the two rear rollers, above the axes of the two rear rollers and wherein the mechanical linkage between the second axle and the auxiliary chassis is such that, when the skate tilts rearward, the second axle descends toward a straight line joining the axes of the two rear rollers so that the discs are applied onto the two rear rollers.

2. The skate as claimed in claim 1, wherein the auxiliary chassis (8) is articulated about the first axle (7) of the penultimate roller, and wherein the mechanical linkage between the second axle (12) and the auxiliary chassis consists of first slots (11) in the auxiliary chassis, which first slots are directed perpendicularly to the straight line joining the axes of the two rear rollers, the second axle being also engaged in second slots (15) of the main chassis, which are transverse to the first slots of the auxiliary chassis, the discs (13) being applied against the auxiliary chassis during braking.

3. The skate as claimed in claim 2, wherein the main chassis (1') is articulated at the front to the boot, and wherein a third elastic means (18) is arranged between the heel of the boot and the main chassis, above the axis of the penultimate roller.

4. The skate as claimed in claim 1, wherein the auxiliary chassis (21) is articulated onto the main chassis (22) about the first axle (23) located between the two rear rollers, equidistant between these axes, and wherein the second axle (12) is located at the upper end of an articulated system, of the pantograph type, formed by the two chassis (21, 22) and by two levers (26, 28), one (26) of which is articulated onto the main chassis and the other (28) of which is articulated onto the auxiliary chassis, the other lever (28) being in the form of a plate against which the discs (13) are applied during braking.

5. The skate as claimed in claim 1, wherein the discs (13) are supported by a fork (38) joining the main chassis (34) to the auxiliary chassis (36) by means of two articulations (37, 39), braking taking place by friction of the discs against the fork.

6. The skate as claimed in claim 5, wherein the first elastic means which counteracts the tilting of the main chassis (34) consists of two flexural springs (41) which bear, on the one hand, on the two chassis and, on the other hand, on the fork so as to push the fork upward.

7. The skate as claimed in claim 6, in which the boot is fixed rigidly to the main chassis, wherein the first elastic means which counteract the tilting of the main chassis consist of a tension spring joining the axle (40) of the discs to the boot.

8. The skate as claimed in claim 5, wherein the movement of the fork (38) upward is limited by the articulated ends of the two chassis coming to abut against the bottom of the fork.

9. The skate as claimed in claim 1, wherein the auxiliary chassis (45) is articulated onto the rear end of the main chassis (44) about the first axle (46) to which the axle (48) of the brake discs is joined by a vertical bar (47), wherein the ends of this axle (48) are rigidly fixed to two discs (49) arranged on either side of the brake discs (13), and wherein the first elastic means consists of two flexural springs (41) bearing (42, 50) on the two chassis and, on the other hand, on the first axle (46) of the articulation of the two chassis.

* * * * *

UNITED STATES PATENT AND TRADEMARK OFFICE

CERTIFICATE OF CORRECTION

PATENT NO. : 5,927,728

DATED : July 27,1999

INVENTOR(S) : GIGNOUX

It is certified that error appears in the above-identified patent and that said Letters Patent is hereby corrected as shown below:

In the drawings figure 5, should be deleted and substitute therefor figure 5 as shown on the attached page.

Signed and Sealed this

Sixth Day of June, 2000

*Attest:*

Q. TODD DICKINSON

*Attesting Officer*

*Director of Patents and Trademarks*